US008163233B2

(12) United States Patent
Amaya et al.

(10) Patent No.: US 8,163,233 B2
(45) Date of Patent: Apr. 24, 2012

(54) MARTENSITIC STAINLESS STEEL FOR WELDED STRUCTURES

(75) Inventors: Hisashi Amaya, Kyoto (JP); Kazuhiro Ogawa, Nishinomiya (JP); Akira Taniyama, Hyogo (JP); Masakatsu Ueda, Nara (JP); Hideki Takabe, Osaka (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 450 days.

(21) Appl. No.: 12/379,724

(22) Filed: Feb. 27, 2009

(65) Prior Publication Data

US 2009/0232694 A1 Sep. 17, 2009

Related U.S. Application Data

(63) Continuation of application No. PCT/JP2007/066674, filed on Aug. 28, 2007.

(30) Foreign Application Priority Data

Aug. 31, 2006 (JP) ..... 2006-235424

(51) Int. Cl.
*C22C 38/44* (2006.01)
*C22C 38/42* (2006.01)

(52) U.S. Cl. ..... 420/40; 420/68; 420/69; 420/70; 420/60; 420/61

(58) Field of Classification Search ..... 148/909, 148/325, 327, 333–335; 420/40, 43, 49, 420/52–54, 56–58, 60, 61, 67–70
See application file for complete search history.

(56) References Cited

U.S. PATENT DOCUMENTS 5,716,465 A * 2/1998 Hara et al. ..... 148/325

FOREIGN PATENT DOCUMENTS

| | | |
|---|---|---|
| AR | 035109 | 4/2004 |
| AR | 036879 | 10/2004 |
| AR | 036880 | 10/2004 |
| AR | 042494 | 6/2005 |
| AR | 045073 | 10/2005 |
| AR | 047867 | 3/2006 |
| CA | 2 296 349 | 1/1999 |
| CA | 2 532 222 | 1/2005 |
| JP | 59-208055 | 11/1984 |

(Continued)

OTHER PUBLICATIONS

Machine-English translation of Japanese patent 2001-220653, Takabe Hideki et al., Aug. 14, 2001.*

(Continued)

*Primary Examiner* — Deborah Yee
(74) *Attorney, Agent, or Firm* — Clark & Brody

(57) ABSTRACT

A martensitic stainless steel for welded structures including by mass %, C: 0.001 to 0.05%, Si: 0.05 to 1%, Mn: 0.05 to 2%, P: 0.03% or less, REM: 0.0005 to 0.1%, Cr: 8 to 16%, Ni: 0.1 to 9% and sol. Al: 0.001 to 0.1%; and further including one or more elements selected from among Ti: 0.005 to 0.5%, Zr: 0.005 to 0.5%, Hf: 0.005 to 0.5%, V: 0.005 to 0.5% and Nb: 0.005 to 0.5%; and O: 0.005% or less, N: 0.1% or less, with the balance being Fe and impurities; and the P and REM content satisfies: $P \leqq 0.6 \times REM$. This steel possesses excellent SCC (stress corrosion cracking) resistance in welded sections in Sweet environments.

8 Claims, 1 Drawing Sheet

FOREIGN PATENT DOCUMENTS

| | | |
|---|---|---|
| JP | 62-54063 | 3/1987 |
| JP | 3-75337 | 3/1991 |
| JP | 5-263137 | 10/1993 |
| JP | 7-41909 | 2/1995 |
| JP | 8-199236 | 8/1996 |
| JP | 9-41092 | 2/1997 |
| JP | 9-227934 | 9/1997 |
| JP | 11-256281 | 9/1999 |
| JP | 2001-220653 | 8/2001 |
| JP | 2006-110585 | 4/2006 |
| SU | 988502 | 1/1983 |
| SU | 1340213 | 4/1991 |
| WO | 2005/017222 | 2/2005 |

OTHER PUBLICATIONS

English-hand translation of Japanese patent 62054063 , Takao Kurisu et al, Mar. 9, 1987.*

M. Ueda et al., "Corrosion Resistance of Weldable Super 13CR Stainless Steel in $H_2S$ Containing $CO_2$ Environments", Corrosion 96, The NACE Int'l. Annual Conference and Exposition, Paper No. 58, Copyright 1996 by NACE International.

Gulyaev, A.P., Metal Science, M: Metallurgy, 1986, p. 303.

Gulyaev, A.P., Pure Steel, M.: Metallurgy, 1975, p. 10.

* cited by examiner

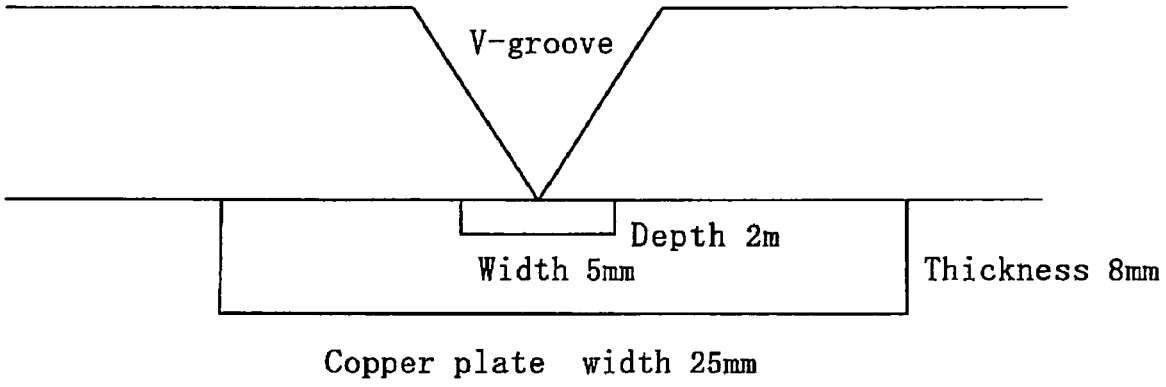
V-groove
Depth 2m
Width 5mm
Thickness 8mm
Copper plate width 25mm

MARTENSITIC STAINLESS STEEL FOR WELDED STRUCTURES

This application is a continuation of International Patent Application No. PCT/JP2007/066674, filed Aug. 28, 2007. This PCT application was not in English as published under PCT Article 21(2).

The disclosure of International Application No. PCT/JP2007/066674 filed Aug. 28, 2007 including specification, drawings and claims is incorporated herein by reference in its entirety.

TECHNICAL FIELD

The present invention relates to a martensitic stainless steel utilized in welded structures, and more particularly to a martensitic stainless steel for welded structures with excellent resistance to stress corrosion cracking.

BACKGROUND ART

Oil or natural gas produced from oil and gas fields contains highly corrosive gases such as carbon dioxide ($CO_2$) and hydrogen sulfide ($H_2S$). The steel utilized in welded structures such as pipelines that convey these types of highly corrosive fluids is required to possess excellent resistance to corrosion. Many studies have been made of sulfide stress cracking (hereinafter referred to as "SSC") caused by hydrogen sulfide and total surface corrosion caused by carbon dioxide gas in steel material for welded structures.

Adding Cr, for example, is known to lower the corrosion speed. Therefore in high-temperature carbon dioxide gas environments, martensitic stainless steel with an increased Cr content such as 13Cr steel is utilized in the steel pipeline material.

However, SSC occurs in martensitic stainless steel in environments containing trace amounts of hydrogen sulfide. Cracks caused by SSC quickly penetrate through a thick plate in a short time and are also a localized phenomenon, and thus enhancement of the ability to withstand SSC (hereinafter referred to as, "SSC resistance") is even more important than improvement in overall resistance to corrosion.

Adding molybdenum and nickel in appropriate quantities to the martensitic stainless steel is effective in stabilizing the anti-corrosiveness of covering films in hydrogen sulfide environments to improve the SSC resistance. Patent document 1 discloses a technology for adding Ti, Zr, and rare earth metals (REM) to fix P, which weakens the SSC resistance, and thus lowers P in solid solution to essentially obtain a low P content.

Non-patent document 1 discloses a technology for lowering the C content in the base metal to inhibit a rise in hardness in sections affected by the welding heat (hereinafter, this "heat affected zone" will be referred to as "HAZ") and thus improve the SSC resistance in the welded section.

In recent years, stress corrosion cracking (herein after referred to as "SCC"), is becoming a drastic problem in martensitic stainless steel used in high-temperature carbon dioxide gas environments (hereinafter referred to as "Sweet Environment"), which have high temperatures from approximately 80-200° C. and contain $CO_2$ and chloride ions. SCC is a similar phenomenon to SSC in that cracks swiftly penetrate through thick plates in a short time and that they occur locally.

A technology for improving the stress corrosion cracking resistance (hereinafter referred to as "SCC resistance") in the HAZ of martensitic stainless steel in Sweet environments is disclosed, for example, in patent document 2 as a method for producing a circular welded joint where the P content is limited within 0.010%.

[Patent document 1] JP1993-263137A

[Patent document 2] JP2006-110585A

[Non-patent document 1] M. Ueda et al.: Corrosion/96 Paper No. 58, Denver

DISCLOSURE OF THE INVENTION

Problems to be Solved by the Invention

As shown below, the technologies described in these documents do not resolve the problem of SCC occurring in welded sections of martensitic stainless steel in Sweet environments.

That is, for REM, its bonding with P is strong but the bonding with O is extremely strong, and therefore REM cannot sufficiently fix P unless the O content is regulated sufficiently. However, the invention described in patent document 1 does not address the special issue of the O content in the steel, and even if better SSC resistance is attained, the invention does not improve the SCC resistance.

The technology disclosed in non-patent document 1 is effective in limiting the hardness against SSC in hydrogen sulfide environments, but susceptibility to SCC in Sweet environments is not related to the hardness. Moreover, the technology described in this document does not deal with the issue of limiting the amount of P in solid solution.

In the invention in patent document 2, REM is added for nothing more than to obtain hot workability and stable productivity in continuous casting. This fact can be understood from examining the examples of patent document 2. That is, a steel containing REM additives is utilized as an example for steel L in patent document 2, where the REM additives are added to the steel along with B and Mg. The purpose of these additives is clearly to achieve hot workability and stable productivity in continuous casting. The invention in patent document 2 also gives no consideration to the O quantity in the steel.

Therefore, eliminating the problem of SCC in welded sections in martensitic stainless steel in Sweet environments requires extremely strict limits on the P content in solid solution.

The object of the present invention is to solve the aforementioned problems by providing a martensitic stainless steel for welded sections possessing excellent SCC resistance.

Means for Solving the Problem

The cause of SCC is known to be what is called "sensitization", which produces a Cr-deprived layer that accompanies the deposition of Cr carbide (Cr carbide compound). This sensitization occurs particularly in austenite type stainless steel but also occasionally occurs in ferrite type or martensitic stainless steel. One method known to prevent sensitization is to add elements, such as Ti or Nb, in appropriate quantities that easily generate carbide compounds to inhibit Cr carbide deposition.

The present inventors made a detailed study of the states causing SCC to occur in Sweet environments by utilizing welded joints of martensitic stainless steel with and without Ti additives and discovered the following items (a) through (e).

(a) When there are tiny Cr depleted sections in grain boundaries in sections of the welding base metal outer layer formed by the welding oxidation scale, then these serve as start points for SCC in the HAZ of the welded sections.

(b) Cracks from SCC in martensitic stainless steel with Ti additive mainly occur near high-temperature HAZ formations along flow lines from weld sections, and propagate along the prior austenite grain boundaries. However, SCC cracks do not occur in low-temperature HAZ formations affected by hysteresis that form sensitization regions in the martensitic stainless steel with Ti additives.

(c) In martensitic stainless steel without Ti additives, SCC occurs in both low-temperature HAZ formations and high-temperature HAZ formations.

(d) Cracks from SCC do not occur when the base metal of the weld joint contains REM in appropriate quantities, the P content is low, and the relation "P≦0.6 REM" is satisfied.

(e) B is prone to segregate along the particle boundary, and is an element that enhances susceptibility to SCC in the HAZ, and thus is not to be added.

After making a detailed evaluation of the relation between P and REM and prior austenite grain boundaries in sections with high-temperature HAZ formations, the present inventors discovered the following important points (f) through (j) about martensitic steel weld joints with "element stabilizing" additives such as Ti.

(f) In order to inhibit SCC in sections with high-temperature HAZ formations, the element composition of the base metal should be adjusted to inhibit the generation of δ-ferrite in high-temperature HAZ formations.

(g) Even if δ-ferrite is generated in sections with high-temperature HAZ formations, the SCC can be prevented in high-temperature HAZ formations by adding REM in appropriate quantities to the base metal, thereby fixing P and reducing the P content to 0.03% or less.

(h) The P segregation along the prior austenite grain boundary exerts a large effect on SCC.

(i) REM easily segregates along the prior austenite grain boundary in the cooling process after welding. REM renders an extremely large effect on preventing SCC from occurring because REM and P that segregated along the prior austenite grain boundary form REM-P—O compounds or REM-P compounds, thus fixing P.

(j) In the melting process during production, REM, P, and O form REM-P—O compounds, REM-O compound, and REM-P compounds. However, forming of the REM-O compounds takes priority when there is a large O content in the steel. Even though a portion of the REM-O compounds are broken down temporarily during welding, the content of REM acting on P is reduced in the cooling process after welding. Therefore, reducing the O content in the steel is an essential condition for obtaining the effect in (i).

The effect on the SCC caused by P segregated along the prior austenite grain boundary and the δ-ferrite in the "high-temperature HAZ" is considered as follows.

The state of martensite stainless steel inverts to austenite (hereinafter also referred to as "γ") when its temperature rises due to heat from welding, and when the temperature further rises, δ-ferrite is generated. The concentration of P, which serves as the element to form the ferrite, is higher in the δ-ferrite than in austenite. In the cooling process after welding, the austenite inverts back to martensite after falling below the Ms point, with the δ-ferrite becoming slightly smaller. The ratio between the δ-ferrite and the austenite fluctuates according to the temperature during cooling, and the element to form the ferrite concentrates within the δ-ferrite.

As a result, the concentration of P, which serves as the element to form the ferrite, becomes high on the δ-ferrite side at the "δ/γ" boundary. As the cooling further proceeds to reach room temperature, most of the formation from welding HAZ turns again into martensite, though partially having the δ-ferrite. Phosphorus (P) concentrates in the δ-ferrite present at high-temperatures, and thus the concentration of segregated P becomes high at the prior austenite grain boundary in the sections with high-temperature HAZ formations, causing SCC cracks to occur.

The present invention has been made on the basis of the foregoing knowledge, and is drawn to a martensite stainless steel for welded structures summarized in the following aspects (1) through (4).

(1) A martensitic stainless steel for welded structures including by mass %, C, 0.001 to 0.05%, Si: 0.05 to 1%, Mn: 0.05 to 2%, P: 0.03% or less, REM: 0.0005 to 0.1%, Cr: 8 to 16%, Ni: 0.1 to 9% and sol. Al: 0.001 to 0.1%; and further including one or more elements selected from among Ti: 0.005 to 0.5%, Zr: 0.005 to 0.5%, Hf: 0.005 to 0.5%, V: 0.005 to 0.5% and Nb: 0.005 to 0.5%; and O: 0.005% or less, N: 0.1% or less, with the balance being Fe and impurities; and the P and REM content satisfies: P≦0.6×REM.

(2) The martensitic stainless steel for welded structures according to (1), further including Mo+0.5W: 7% or less in lieu of part of Fe.

(3) The martensitic stainless steel for welded structures according to (1) or (2), further including Cu: 3% or less in lieu of part of Fe.

(4) The martensitic stainless steel for welded structures according to any one of (1) to (3), further including one or more elements selected from among Ca: 0.0005 to 0.1% and Mg: 0.0005 to 0.1% in lieu of part of Fe.

The above aspects (1) through (4) for the martensite stainless steel for welded structures of the present invention are respectively referred to as "the present invention (1)" through "the present invention (4)", and occasionally collectively referred to as "the present invention".

Effect of the Invention

The martensitic stainless steel of the present invention possesses excellent SCC resistance in welded sections in Sweet environments, and therefore finds applications in, for example, welded structures such as pipelines for transporting fluids including oil and natural gas containing high-temperature carbon-dioxide gas or chloride ions, which are corrosive to metal.

BRIEF DESCRIPTION OF THE DRAWINGS

FIG. 1 illustrates a welding test specimen.

BEST MODE FOR CARRYING OUT THE INVENTION

The requirements of the present invention will be described below in detail. It is noted that the "%", as used herein, for chemical content signifies "mass %".

C, 0.001-0.05%

Carbon (C) is an element that forms carbides with Cr to lower corrosion resistance in high-temperature carbon dioxide gas environments. Carbon also raises the hardness of HAZ and therefore is an element to degrade corrosion resistance in HAZ. Carbon also degrades weldability. In view of this, the C content is as low as possible, with the upper limit being 0.05%. However, the substantially controllable lower limit of the C content is approximately 0.001%. The C content is therefore usually set between 0.001-0.05%.

Si: 0.05-1%

Silicon (Si) is an element added as a deoxidizer in the steel refining process. A Si content of 0.05% or more is required for a sufficient deoxidizing effect. However, a Si content exceeding 1% will saturate the effect. The Si content is therefore set between 0.05-1%.

Mn: 0.05-2%

Manganese (Mn) is an element for improving the hot working process and a Mn content of 0.05% or more is required to sufficiently achieve this effect. However, Mn easily segregates internally in steel fragments and steel clusters when the Mn content exceeds 2%. This segregation leads to a drop in toughness or tends to cause deterioration in the SSC resistance in environments containing hydrogen sulfide. The Mn content is therefore set between 0.05-2%.

P: 0.03% or Less

Phosphorus (P) is a critical element in the present invention and is required to be limited to a low content. The P content is therefore set at 0.03% or less. The P content is preferably set at 0.013% or less. The P content is more preferably set with 0.010% or less, and a content of 0.005% or less is extremely preferable. Merely lowering the P content is insufficient for preventing SCC. It is important to first add REM, lower O, and then limit the P content within the above range.

REM: 0.0005-0.1%

REM is a critical element in the present invention. That is, using a fixed P added to REM in steel where the P content is 0.03% or less and the 0 content is 0.005% or less makes it difficult for SCC to occur in welded sections. This effect is obtained when the REM content is 0.0005% or more, but a REM content more than 0.1% will saturate the effect and lead to higher costs. The REM content is therefore set between 0.0005-0.1%. The REM content is preferably set between 0.026-0.1%.

Cr: 8-16%

Chromium (Cr) is an indispensable element for obtaining resistance to corrosion in carbon dioxide gas environments. A Cr content of 8% or more is required for obtaining corrosion resistive in high-temperature carbon dioxide gas environments. However, Cr is an element to form ferrite, and therefore produces δ-ferrite when the Cr content is too high, which leads to a drop in hot workability. The Cr content is therefore set between 8-16%.

Ni: 0.1-9%

Nickel (Ni) provides the effect of improving toughness as well as enhancing corrosion resistance. To achieve these effects, a Ni content of 0.1% or more is required. However, Ni is an element to form austenite, and so an excessive Ni content produces residual austenite to lower strength and toughness. This tendency is notable when the nickel content exceeds 9%. The Ni content is therefore set between 0.1-9%.

Sol. Al: 0.001-0.1%

Aluminum (Al) is an element added to serve as a deoxidizer in the steel refining process. In order to achieve this effect, the Al content is required to be 0.001% or more as sol. Al. However, adding large amounts of Al increases the number of Al inclusions, which causes a drop in toughness. The drop in toughness becomes notable especially when the Al content exceeds 0.1% sol. Al. The Al content is therefore set to 0.001-0.1% sol. Al.

One or more elements selected from among Ti: 0.005-0.5%, Zr: 0.005-0.5%, Hf: 0.005-0.5%, V: 0.005-0.5%, and Nb: 0.005-0.5%

Each of Ti, Zr, Hf, V, and Nb possesses a larger affinity to C than Cr and therefore act to inhibit the production of Cr carbides, and inhibit the generation of localized SCC and corrosion in low-temperature HAZ structures caused by Cr-depleted layers in the vicinity of the Cr carbide. These elements are referred to as "stabilizing elements" in the stainless steel. These effects can be obtained with any of Ti, Zr, Hf, V and Nb at a content of 0.005% or more. However, when the content of any of these elements exceeds 0.5%, large rough inclusions occur that may cause the toughness to deteriorate. The content of one or more elements selected from among Ti, Zr, Hf, V and Nb is therefore set between 0.005-0.5%.

It is noted that one element from any of the above Ti, Zr, Hf, V and Nb, or a composite of two or more elements are required to be contained.

For the above reasons, the martensitic stainless steel for welded structures of the present invention (1) is specified as containing C, Si, Mn, P, REM, Cr, Ni, and sol. Al in the above-specified ranges; and also specified as containing one or more elements selected from among Ti, Zr, Hf, V and Nb in the above-specified ranges, with the balance being Fe and impurities.

For the reasons described below, O in the impurities is required to be limited within 0.005%, and N within 0.1%. Moreover, other impurities such as S lower corrosion resistance and toughness as in the case of normal stainless steel, and so each content within the steel is preferably kept as small as possible.

O: 0.005% or Less.

Oxygen (O), along with REM, forms oxides. Therefore, when the steel contains large quantities of O, the quantity of REM for fixing P becomes small, so that SCC is prone to occur in the welded sections. Therefore, the O content is preferably kept as small as possible, within 0.005%.

N: 0.1% or Less

Nitrogen (N) causes corrosion resistance to deteriorate in the HAZ similarly to C, and therefore the upper limit is set at 1.0%.

If the martensitic stainless steel satisfies the relation, "$P \leqq 0.6 \times REM$" for P and REM content, then no SCC will occur in the welded sections in Sweet environments.

This is because REM that segregated in the grain boundaries of the prior austenite in the cooling process after welding forms REM-P compounds or REM-P—O compounds with P that segregated in the grain boundaries of prior austenite, thus fixing P.

Therefore, the martensitic stainless steel of the present invention (1) for welded structures therefore satisfies $P \leqq 0.6 \times REM$.

To obtain even better characteristics, the martensitic stainless steel of the present invention may contain, in lieu of part of Fe of the present invention (1), one or more elements in at least one group selected from among:

First Group: Mo+0.5W: 7% or Less

Second group: Cu: 3% or less

Third group: one or more elements selected from among: Ca: 0.01% or less and Mg: 0.01% or less.

Description will be made of each of the above elements.

First Group: Mo+0.5W: 7% or Less

The first group may contain either one or both of Mo and W, because they, when coexistent with Cr, function to improve the SSC resistance and pitting corrosion resistance. However, a large Mo and W content, and particularly a content exceeding 7% at Mo+0.5W, may cause generation of ferrite, thereby deteriorating hot workability. Therefore, if the content includes both Mo and W, then their single or combined content preferably is 7% or less at Mo+0.5W. To secure that the above effect is achieved, the content is preferably made 0.1% or more.

It is noted that the content may include 7% of Mo if there is no W, and the content may include 14% of W if there is no Mo.

Second Group: Cu: 3% or Less

Copper (Cu) provides the effect of slowing the dissolving speed in low pH environments. However, hot workability deteriorates when the Cu content exceeds 3%. Therefore, when Cu is added, its content is preferably within 3%. To secure the above effect is achieved the content is preferably made 0.1% or more.

However, when the content contains Cu, then the Cu content is preferably limited to one-half (½) the Ni content in order to prevent occurrence of Cu checking.

Third Group: One or More Elements Selected from Among: Ca: 0.01% or Less and Mg: 0.01% or Less.

Calcium (Ca) provides the effect of improving the hot workability of the steel. However, if the Ca content is large and in particular exceeds 0.01%, then the Ca forms large, rough inclusions that cause the SSC resistance and toughness to deteriorate. Therefore, when Ca is added, its content is preferably within 0.01%. To secure that the above effect is achieved, the content is preferably 0.0005% or more.

Magnesium (Mg) provides the effect of improving the hot workability of the steel. However, if the Mg content is large and in particular exceeds 0.01%, then Mg forms large, rough inclusions that cause the SSC resistance and toughness to deteriorate. Therefore, when Mg is added, its content is preferably within 0.01% or less. To secure that the above effect is achieved, that content is preferably made 0.0005% or more.

The content may include either one of Ca and Mg, or the two elements combined.

For the above reasons, the martensitic stainless steel of the present invention (2) is specified as containing Mo+0.5W at 7% or less in lieu of part of Fe in the steel of the present invention (1).

A martensitic stainless steel of the present invention (3) for welded structures contains Cu at 3% or less in lieu of part of Fe in the steel of the present invention (1) or (2).

A martensitic stainless steel of the present invention (4) for welded structures contains one type or more among Ca: 0.01% or less and Mg: 0.01% or less in lieu of part of Fe in the steel of any one of the present invention (1) through (3).

The invention will be described in detail with reference to embodiments.

EMBODIMENTS

Martensitic stainless steel pieces A-R with chemical compositions shown in Table 1 were melted and fabricated into steel plates of 100 mm wide and 12 mm thick.

TABLE 1

| | Chemical Composition (Mass %. Remainder: Fe and impurities) | | | | | | | | | | | |
|---|---|---|---|---|---|---|---|---|---|---|---|---|
| Steel | C | Si | Mn | P | S | Cr | Ni | Mo | W | Sol-Al | Ti | Zr |
| A | 0.008 | 0.22 | 0.49 | 0.013 | 0.001 | 11.68 | 6.45 | 2.45 | — | 0.031 | 0.090 | — |
| B* | 0.008 | 0.22 | 0.52 | 0.013 | 0.001 | 11.71 | 6.43 | 2.42 | — | 0.008 | 0.072 | — |
| C* | 0.024 | 0.21 | 0.46 | 0.008 | 0.001 | 11.92 | 6.51 | 2.34 | — | 0.025 | 0.081 | — |
| D | 0.012 | 0.21 | 0.45 | 0.018 | 0.001 | 12.05 | 6.38 | 2.40 | — | 0.035 | 0.088 | — |
| E | 0.011 | 0.21 | 0.45 | 0.012 | 0.001 | 12.01 | 6.39 | 2.39 | — | 0.037 | 0.089 | — |
| F* | 0.011 | 0.21 | 0.46 | 0.027 | 0.001 | 11.99 | 6.41 | 2.40 | — | 0.033 | 0.084 | — |
| G* | 0.013 | 0.20 | 0.46 | 0.010 | 0.001 | 11.98 | 6.42 | 2.38 | — | 0.022 | 0.078 | — |
| H* | 0.011 | 0.20 | 0.46 | 0.027 | 0.001 | 12.07 | 6.49 | 2.40 | — | 0.036 | 0.093 | — |
| I | 0.012 | 0.20 | 0.45 | 0.016 | 0.001 | 12.15 | 6.32 | 2.43 | — | 0.035 | 0.097 | — |
| J | 0.010 | 0.21 | 0.46 | 0.029 | 0.001 | 12.08 | 6.54 | 2.40 | — | 0.018 | 0.078 | — |
| K | 0.010 | 0.20 | 0.46 | 0.016 | 0.001 | 12.03 | 6.49 | 2.39 | — | 0.031 | 0.084 | — |
| L | 0.014 | 0.21 | 0.46 | 0.015 | 0.001 | 12.07 | 6.45 | 2.40 | — | 0.034 | 0.092 | — |
| M | 0.011 | 0.18 | 0.45 | 0.016 | 0.001 | 11.95 | 6.50 | 2.38 | — | 0.044 | 0.099 | — |
| N | 0.010 | 0.18 | 0.46 | 0.010 | 0.001 | 11.98 | 6.50 | 2.37 | — | 0.022 | 0.066 | — |
| O* | 0.011 | 0.21 | 0.45 | 0.018 | 0.001 | 12.08 | 6.28 | 2.44 | — | 0.014 | 0.078 | — |
| P | 0.015 | 0.25 | 0.55 | 0.017 | 0.001 | 13.81 | 7.02 | — | 5.21 | 0.022 | 0.054 | 0.066 |
| Q | 0.011 | 0.19 | 0.47 | 0.015 | 0.001 | 14.59 | 6.55 | — | — | 0.018 | — | — |
| R | 0.02 | 0.21 | 0.48 | 0.018 | 0.001 | 12.4 | 5.88 | 1.14 | — | 0.015 | 0.078 | — |

| | Chemical Composition (Mass %. Remainder: Fe and impurities) | | | | | | |
|---|---|---|---|---|---|---|---|
| Steel | V | Nb | REM | O | N | Others | ① |
| A | 0.06 | — | 0.026Nd | 0.003 | 0.0083 | — | −0.003 |
| B* | 0.06 | — | —* | 0.004 | 0.0077 | — | 0.013* |
| C* | 0.11 | — | 0.012Nd | 0.003 | 0.0080 | — | 0.001* |
| D | 0.10 | — | 0.037Nd | 0.003 | 0.0083 | — | −0.004 |
| E | 0.06 | — | 0.049Nd | 0.002 | 0.0082 | — | −0.017 |
| F* | 0.06 | — | 0.043Nd | 0.001 | 0.0084 | — | 0.001* |
| G* | 0.06 | — | 0.013Nd | 0.004 | 0.0087 | — | 0.002* |
| H* | 0.06 | — | 0.031Nd | 0.004 | 0.0069 | — | 0.008* |
| I | 0.07 | — | 0.040Y | 0.003 | 0.0090 | — | −0.008 |
| J | 0.07 | — | 0.060La | 0.004 | 0.0084 | — | −0.007 |
| K | 0.06 | — | 0.062Ce | 0.001 | 0.0079 | — | −0.021 |
| L | 0.06 | — | 0.026Nd | 0.001 | 0.0093 | 0.001Ca | −0.001 |
| M | 0.07 | — | 0.036Nd | 0.001 | 0.0087 | 0.004Mg | −0.006 |
| N | 0.09 | 0.10 | 0.018Nd | 0.002 | 0.0097 | — | −0.001 |
| O* | 0.07 | — | 0.031Nd | 0.007* | 0.0093 | — | −0.001 |
| P | 0.05 | — | 0.033Nd | 0.002 | 0.0100 | — | −0.003 |
| Q | — | 0.15 | 0.028Nd | 0.003 | 0.0089 | — | −0.002 |
| R | — | — | 0.041Nd | 0.003 | 0.0074 | 1.98Cu | −0.007 |

*Mark signifies a deviation from the range specified for the present invention.

① Signifies a value calculated for the relation "P − 0.6 × REM".

Specimens for a round bar tensility test with a length of 65 mm and diameter of 6 mm in the straight section were taken from the center section in terms of the width and thickness of the steel plates. The tensility test was performed at room temperature and the yield strength (YS) was measured. A V-groove bevel with a groove angle of 15 degrees was machined perpendicular to the steel plate rolling direction, and multiple layers were welded from one side of the groove by MAG welding to form a welded joint. A dual-phase stainless steel welding material of "25Cr-7Ni-3Mo-2W" alloy was utilized for the MAG welding. In order to support the molten metal during the MAG welding, a copper plate was placed against the rear side of the groove as shown in FIG. 1. The copper plate was 25 mm in width and 8 mm thick and had a groove with a depth of 2 mm and width of 5 mm perpendicular to the welding line.

SCC specimen pieces with a thickness of 2 mm, width of 10 mm, and length of 75 mm, with welding beads and welding scale on the surface from the first layer of the weld joint obtained in the above manner were taken so that the test piece length was perpendicular to the weld line, and the SCC test performed. Table 2 shows conditions for the SCC test and Table 3 shows results from the tensility test and SCC test.

TABLE 2

| Solution | Gas | Temp. | Test Time | Test Method | Load Stress |
|---|---|---|---|---|---|
| 25 wt % NaCl | 1013250 Pa $CO_2$ gas (10 atm $CO_2$ gas) | 100° C. | 720 h | 4 pt. bend test | 100% base metal YS |

Note:
The first welded layer was utilized unchanged as the test piece.

TABLE 3

| Test No. | Steel | YS (MPa) | SCC occurs YES/NO | Category |
|---|---|---|---|---|
| 1 | A | 648 | NO | Embodiment |
| 2 | B* | 634 | YES | Comparison pc. |
| 3 | C* | 612 | YES | Comparison pc. |
| 4 | D | 669 | NO | Embodiment |
| 5 | E | 654 | NO | Embodiment |
| 6 | F* | 632 | YES | Comparison pc. |
| 7 | G* | 652 | YES | Comparison pc. |
| 8 | H* | 608 | YES | Comparison pc. |
| 9 | I | 616 | NO | Embodiment |
| 10 | J | 650 | NO | Embodiment |
| 11 | K | 747 | NO | Embodiment |
| 12 | L | 639 | NO | Embodiment |
| 13 | M | 638 | NO | Embodiment |
| 14 | N | 732 | NO | Embodiment |
| 15 | O* | 672 | YES | Comparison pc. |
| 16 | P | 705 | NO | Embodiment |
| 17 | Q | 711 | NO | Embodiment |
| 18 | R | 689 | NO | Embodiment |

*Mark signifies a deviation from the range specified for the present invention.

As shown in Table 3, the test pieces No. 1, 4, 5, 9, 10, 11, 12, 13, 14, 16, 17, and 18 of the present invention maintained a satisfactory yield strength and possessed good corrosion resistance without occurrence of SCC. However, SCC was found to occur in the comparison samples No. 2, 3, 6, 7, 8, and 15. A microstructure examination revealed that cracks from SCC in the No. 2 comparison sample propagated along the prior austenite grain boundaries in the high-temperature HAZ structures.

Although only some exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

INDUSTRIAL APPLICABILITY

The martensitic stainless steel of the present invention for welded structures possesses excellent SCC resistance when utilized in welded sections in Sweet environments, and therefore finds applications in welded structures that convey fluids such as oil or natural gas, which are corrosive to metal.

The invention claimed is:

1. A martensitic stainless steel for welded structures comprising by mass %, C: 0.001 to 0.05%, Si: 0.05 to 1%, Mn: 0.05 to 2%, P: 0.03% or less, REM: 0.0005 to 0.1%, Cr: 8 to 16%, Ni: 6.32 to 9% and sol. Al: 0.001 to 0.1%; and further comprising one or more elements selected from among Ti: 0.005 to 0.5%, Zr: 0.005 to 0.5%, Hf: 0.005 to 0.5%, V: 0.005 to 0.5% and Nb: 0.005 to 0.5%; and O: 0.005% or less, N: 0.1% or less, with the balance being Fe and impurities; and the P and REM content satisfies: $P \leqq 0.6 \times REM$, wherein said REM is at least one element selected from Nd and Y.

2. The martensitic stainless steel for welded structures according to claim 1, further comprising Mo+0.5W: 7% or less in lieu of part of Fe.

3. The martensitic stainless steel for welded structures according to claim 1, further comprising Cu: 3% or less in lieu of part of Fe.

4. The martensitic stainless steel for welded structures according to claim 1, further comprising one or more elements selected from among Ca: 0.0005 to 0.1% and Mg: 0.0005 to 0.1% in lieu of part of Fe.

5. The martensitic stainless steel for welded structures according to claim 3, further comprising one or more elements selected from among Ca: 0.0005 to 0.1% and Mg: 0.0005 to 0.1% in lieu of part of Fe.

6. The martensitic stainless steel for welded structures according to claim 2, further comprising Cu: 3% or less in lieu of part of Fe.

7. The martensitic stainless steel for welded structures according to claim 2, further comprising one or more elements selected from among Ca: 0.0005 to 0.1% and Mg: 0.0005 to 0.1% in lieu of part of Fe.

8. The martensitic stainless steel for welded structures according to claim 6, further comprising one or more elements selected from among Ca: 0.0005 to 0.1% and Mg: 0.0005 to 0.1% in lieu of part of Fe.

* * * * *